US011147732B2

(12) United States Patent
Huang et al.

(10) Patent No.: US 11,147,732 B2
(45) Date of Patent: Oct. 19, 2021

(54) CONNECTING ROD TYPE LOWER LIMB EXOSKELETON REHABILITATION ROBOT

(71) Applicant: Huazhong University of Science & Technology, Hubei (CN)

(72) Inventors: Jian Huang, Hubei (CN); Haitao Zhang, Hubei (CN); Zhangbo Huang, Hubei (CN); Xikai Tu, Hubei (CN); Caihua Xiong, Hubei (CN)

(73) Assignee: Huazhong University of Science & Technology, Hubei (CN)

( * ) Notice: Subject to any disclaimer, the term of this patent is extended or adjusted under 35 U.S.C. 154(b) by 638 days.

(21) Appl. No.: 16/059,838

(22) Filed: Aug. 9, 2018

(65) Prior Publication Data

US 2018/0360685 A1 Dec. 20, 2018

Related U.S. Application Data

(63) Continuation-in-part of application No. PCT/CN2017/091929, filed on Jul. 6, 2017.

(30) Foreign Application Priority Data

May 22, 2017 (CN) ..... 201710365590.1

(51) Int. Cl.
*A61H 3/00* (2006.01)
*A61H 1/02* (2006.01)
(Continued)

(52) U.S. Cl.
CPC ..... *A61H 3/00* (2013.01); *A61H 1/024* (2013.01); *A61H 1/0237* (2013.01);
(Continued)

(58) Field of Classification Search
CPC ..... A61H 1/00; A61H 1/001; A61H 1/005; A61H 1/02; A61H 1/0214; A61H 1/0218;
(Continued)

(56) References Cited

U.S. PATENT DOCUMENTS 6,666,831 B1 * 12/2003 Edgerton ..... A61H 1/0237 600/587
7,125,388 B1 * 10/2006 Reinkensmeyer ..... A63B 69/0064 601/5
(Continued)

FOREIGN PATENT DOCUMENTS

CN 101019800 A 8/2007
CN 201005935 Y 1/2008
(Continued)

OTHER PUBLICATIONS

International Search Report and Written Opinion issued in PCT/CN2017/091929, dated Feb. 26, 2018.

*Primary Examiner* — Colin W Stuart
(74) *Attorney, Agent, or Firm* — Hamre, Schumann, Mueller & Larson, P.C.

(57) ABSTRACT

The present invention discloses a connecting rod-type lower limb exoskeleton rehabilitation robot, comprising a treadmill, two pneumatic muscle frames, two transmission devices and two lower limb exoskeletons; the pneumatic muscle frame includes a thigh rotating shaft, a calf rotating shaft, a hip joint shaft, pneumatic muscles and a support frame; the transmission device includes a thigh transmission mechanism and a calf transmission mechanism; the thigh transmission mechanism is a parallel four-connecting-rod mechanism composed of a thigh rotating arm, a thigh connecting rod and a thigh skeleton; the calf transmission mechanism includes two four-connecting-rod mechanisms; and the lower limb exoskeleton is connected to the pneumatic muscle frame through the transmission device. Compared with other exoskeleton rehabilitation robots driven by pneumatic muscles, the exoskeleton rehabilitation robot in the present invention, which concentrates all pneumatic
(Continued)

muscles in the pneumatic muscle framework, has a simple, compact structure, and is safe and easy to operate.

10 Claims, 3 Drawing Sheets

(51) Int. Cl.
*A63B 22/02* (2006.01)
*A63B 21/00* (2006.01)
*A63B 22/00* (2006.01)

(52) U.S. Cl.
CPC ..... *A61H 1/0244* (2013.01); *A61H 1/0262* (2013.01); *A63B 22/02* (2013.01); *A63B 22/0235* (2013.01); *A61H 2201/1238* (2013.01); *A61H 2201/14* (2013.01); *A61H 2201/164* (2013.01); *A61H 2201/165* (2013.01); *A61H 2201/1659* (2013.01); *A61H 2201/50* (2013.01); *A61H 2201/5061* (2013.01); *A61H 2201/5069* (2013.01); *A61H 2203/0406* (2013.01); *A61H 2205/10* (2013.01); *A63B 21/00181* (2013.01); *A63B 2022/0092* (2013.01); *A63B 2022/0094* (2013.01)

(58) Field of Classification Search
CPC .... A61H 1/0237; A61H 1/024; A61H 1/0244; A61H 1/0255; A61H 1/0259; A61H 1/0262; A61H 3/00; A61H 3/008; A61H 2201/12; A61H 2201/1238; A61H 2201/1246; A61H 2201/16; A61H 2201/164; A61H 2201/5056; A61H 2201/5058; A61H 2201/5069; A61H 2201/5061; A61H 2201/14; A61H 2201/165; A61H 2201/1659; A61H 2205/10; A61H 2203/0406; A63B 22/02; A63B 22/0235; A63B 21/00181; A63B 2022/0092; A63B 2022/0094; A61F 2/50; A61F 2/60; A61F 2002/5066; A61F 5/04; A61F 5/01; A61F 5/0102; A61F 5/0123
See application file for complete search history.

(56) References Cited

U.S. PATENT DOCUMENTS

| | | | | |
|---|---|---|---|---|
| 2005/0101448 | A1* | 5/2005 | He | A63B 22/02 482/54 |
| 2008/0249438 | A1 | 10/2008 | Agrawal et al. | |
| 2010/0152629 | A1* | 6/2010 | Haas, Jr. | A63B 21/4011 601/34 |
| 2010/0285929 | A1* | 11/2010 | Bayerlein | A63B 21/00181 482/54 |
| 2014/0087922 | A1* | 3/2014 | Bayerlein | A63B 21/00181 482/54 |
| 2015/0328078 | A1* | 11/2015 | Meuleman | A61H 3/008 482/79 |
| 2018/0071580 | A1* | 3/2018 | Lee | A61H 3/00 |

FOREIGN PATENT DOCUMENTS

| | | | |
|---|---|---|---|
| CN | 101810533 | A | 8/2010 |
| CN | 103417356 | A | 12/2013 |
| CN | 105167965 | A | 12/2015 |
| CN | 105832496 | A | 8/2016 |
| CN | 106420271 | A | 2/2017 |

* cited by examiner

CONNECTING ROD TYPE LOWER LIMB EXOSKELETON REHABILITATION ROBOT

TECHNICAL FIELD

The present invention belongs to the field of pneumatic technology and exoskeleton robot, and more particularly relates to a connecting rod type lower limb exoskeleton rehabilitation robot.

BACKGROUND ART

At present, China has entered an aging population society, and the elderly population is growing. According to statistics, by the end of 2015, the population aged over 60 has reached 222 million, and stroke is one of the major risks faced by the elderly population. Meanwhile, by the end of 2016, the number of motor vehicles in China is 290 million, and various traffic accidents caused by it are also increasing. According to statistics, the number of patients with limb dysfunction caused by stroke and various accidents in China has exceeded 8 million. Most patients with limb dysfunction can improve or restore their motor function through rehabilitation training. At present, in China, rehabilitation training is mainly guided by a professional doctor and is completed with the help of a nurse or a family member, which requires much time and effort. With the development of robotic technology, more and more research institutes have begun to apply the robotic technology to rehabilitation training, resulting in the generation of exoskeleton rehabilitation robots.

At present, most exoskeleton robots in the prior art adopt motor drive or hydraulic drive. The motor drive has the advantages of fast response, convenient control, high precision, simple structure and the like. However, it has a low power-mass ratio and needs to be used with a speed reducer, resulting in the problems that the motor-driven exoskeleton is large in size and difficult to withstand large loads. In addition, the hydraulic drive has a high power-to-mass ratio, but it is still not suitable for use in a rehabilitation exoskeleton robot since its working medium is hydraulic oil which is prone to leakage.

Pneumatic muscle is a kind of driving element that simulates human muscle design according to the principle of bionics. Compared with the motor drive and the hydraulic drive, the pneumatic muscle has, due to its bionics design, a force-displacement relationship similar to that of the human muscle, and is, therefore, more suitable for use in exoskeleton rehabilitation robots. Furthermore, the pneumatic muscle work medium is air, which is colorless and odorless and has no influence on the patient. In addition, the pneumatic muscle has the advantages of high power-to-mass ratio, safety, comfort and the like.

Due to the late start of studies on the exoskeleton, in most exoskeletons, problems of fluctuation of the center of gravity during walking, change of the instantaneous center of the knee and adduction of the thigh in forward bending are not considered, resulting in poor wear comfort of the exoskeleton.

Chinese Patent Publication No. CN101810533A discloses a walking aid exoskeleton rehabilitation robot comprising a mobile auxiliary mechanism, a control mechanism and an exoskeleton prosthesis mechanism, in which the mobile auxiliary mechanism is connected to the exoskeleton prosthesis mechanism, and the control mechanism is connected to the mobile auxiliary mechanism and the exoskeleton prosthesis mechanism, respectively. The exoskeleton prosthesis mechanism has a compact structure and large rotation range of the respective joints, and thus can meet the actual movement requirements of the human body. However, the walking aid exoskeleton rehabilitation robot disclosed in the Patent Publication No. CN101810533A also has the following deficiencies:

(1) the invention does not consider the change of the instantaneous center of the knee and the adduction of the thigh in forward bending, resulting in poor wear comfort of the exoskeleton and the possibility of being unwearable for patients with a malformed leg;

(2) the rehabilitation robot has a large overall structure and requires a wide space for use; and (3) the rehabilitation robot adopts motor drive that requires battery power and thus has limited battery life.

SUMMARY OF THE PRESENT INVENTION

In view of the above-described problems, the present invention provides a connecting rod-type lower limb exoskeleton rehabilitation robot, which aims to concentrate all pneumatic muscles in the pneumatic muscle framework. Compared with other exoskeleton rehabilitation robots driven by pneumatic muscles, the exoskeleton rehabilitation robot in the present invention has a simple and compact structure and is safe and easy to operate.

In order to achieve the above objective, the present invention provides a connecting rod-type lower limb exoskeleton rehabilitation robot, comprising a treadmill, two pneumatic muscle frames, two transmission devices and two lower limb exoskeletons.

The two pneumatic muscle frames are respectively provided on two sides of the treadmill, and each includes a thigh rotating shaft, a calf rotating shaft, a hip joint shaft, pneumatic muscles and a support frame. The support frame is connected to the treadmill with bolts. The thigh rotating shaft is fixed on one side of a top crossbeam of the support frame through two shaft blocks, and the calf rotating shaft is fixed on the other side of the top crossbeam of the support frame through two shaft blocks. The thigh rotating shaft and the calf rotating shaft are each provided with a pneumatic muscle rotating arm in the middle. A pneumatic muscle is hinged at each end of the pneumatic muscle rotating arm. The hip joint shaft is fixed to the outer side of the support frame by a shaft block.

Each of the two transmission devices includes a thigh transmission mechanism and a calf transmission mechanism. The thigh transmission mechanism is a parallel four-connecting-rod mechanism composed of a thigh rotating arm, a thigh connecting rod and a thigh skeleton. The calf transmission mechanism includes a first four-connecting-rod mechanism and a second four-connecting-rod mechanism, the first four-connecting-rod mechanism comprising a first calf rotating arm, a first calf connecting rod and a second calf rotating arm, the second four-connecting-rod mechanism comprising a triangular piece, a calf long connecting rod, a knee joint short connecting rod and the thigh skeleton. The lower limb exoskeleton is connected to the pneumatic muscle frame through the transmission device and includes a thigh portion, a knee joint and a calf portion for fixing the wearer's thigh and calf portions. The pneumatic muscles are inflated and tightened to drive the thigh rotating shaft and the calf rotating shaft to rotate according to the wearer's movement intention and then to drive the hip joint shaft and the knee joint to rotate, thereby achieving the action of walking rehabilitation.

Further, the thigh portion and the calf portion have the same structure and include a thigh skeleton, slide rails, sliding blocks, sensor fixing bases and a calf skeleton. In addition, the thigh skeleton is in interference fit with the hip joint shaft, the slide rails are respectively fixed on the thigh skeleton and the calf skeleton by screws, and the respective sliding block is arranged on the surface of the slide rail and passes through the sensor fixing base. Further, the sliding block is used for driving the sensor fixing base to slide on the slide rail.

Further, the knee joint includes two parallel four-connecting-rod mechanisms, each comprising a plurality of knee joint long connecting rods, and a knee joint triangular connecting rod is provided between the two parallel four-connecting-rod mechanisms and is connected to the thigh skeleton and the calf skeleton through the two parallel four-connecting-rod mechanisms.

Further, a cantilever beam sensor is connected to the sensor fixing base by screws, a guide pillar fixing base is provided at the end of the cantilever beam sensor and has a through hole for receiving a guide pillar which is cylindrical, and a bandage sliding block is sleeved and slidable on the guide pillar.

Further, an angle sensor is respectively provided between the triangular piece and the calf long connecting rod and between the thigh connecting rod and the thigh rotating arm.

Further, a housing of the angle sensor is connected to a sensor bracket by screws. The sensor bracket is used for connecting with the thigh connecting rod, the thigh skeleton or the triangular piece. Furthermore, the rotating shaft of the angle sensor is connected to the thigh rotating arm, the calf long connecting rod or the second calf connecting rod by a pin shaft.

Further, on the pneumatic muscle rotating arms and the base plate, three mounting holes are provided for one pneumatic muscle such that the rotating moment arm between the pneumatic muscle and the corresponding rotating shaft is adjustable.

Further, a force sensor is mounted on the pneumatic muscle to measure the force of the pneumatic muscle, and a joint bearing is provided at each end of the pneumatic muscle, in which a pneumatic muscle connecting piece is hinged to the lower joint bearing.

Further, the thigh rotating shaft is in key connection with the pneumatic muscle rotating arms and the thigh rotating arm, respectively.

Further, the number of the pneumatic muscles in each pneumatic muscle frame is four.

In general, compared with the prior art, the present invention has the following beneficial effects:

(1) in the present invention, a connecting rod structure is adopted to concentrate all the pneumatic muscles in the pneumatic muscle framework, so that compared with other exoskeleton rehabilitation robots driven by pneumatic muscles, the exoskeleton rehabilitation robot in the present invention has a simple and compact structure and is safe and easy to operate;

(2) in the present invention, considering the fluctuation of the center of gravity during walking, a guide rail and sliding block mechanism is used such that the bandages connected to the thigh and the calf can slide up and down to solve the problem of the fluctuation of the center of gravity;

(3) in the present invention, considering the adduction of the thigh in forward bending during the walking, a guide pillar and sliding block mechanism is used such that the bandages connected to the thigh and the calf can slide left and right to solve the problem of the adduction of the thigh in forward bending;

(4) in the present invention, considering the change of the instantaneous center of the knee, two four-bar linkage mechanisms are used to achieve the function of the change of the instantaneous center of the knee; and (5) in the present invention, a multi-degree-of-freedom design is adopted such that the exoskeleton rehabilitation robot can be adapted to patients of different physiques for rehabilitation training.

DETAILED DESCRIPTION OF THE EMBODIMENTS

For the clear understanding of the objectives, features and advantages of the present invention, detailed description of the present invention will be given below in conjunction with accompanying drawings and specific embodiments. It should be noted that the embodiments described herein are only meant to explain the present invention, and not to limit the scope of the present invention.

Figure 1:
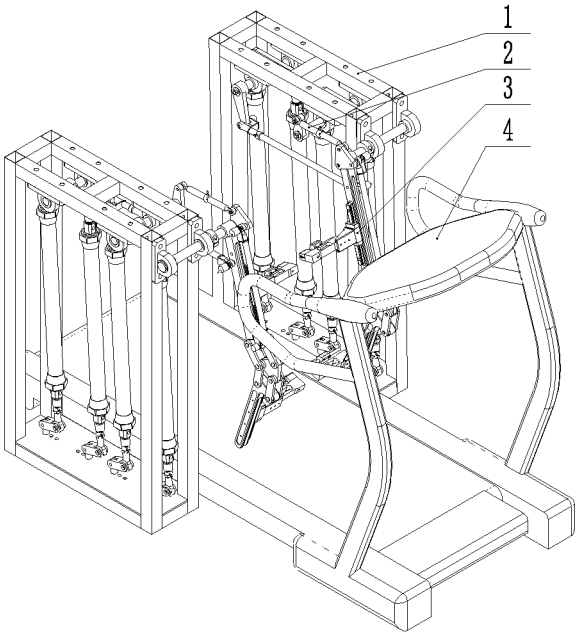
FIG. 1 is a schematic diagram of an overall structure of a connecting rod-type lower limb exoskeleton rehabilitation robot according to an embodiment of the present invention.

FIG. 1 is a schematic diagram of an overall structure of a connecting rod-type lower limb exoskeleton rehabilitation robot according to an embodiment of the present invention. As shown in FIG. 1, the rehabilitation robot includes two pneumatic muscle frames 1, two transmission devices 2, two lower limb exoskeletons 3 and a programmable treadmill 4.

Figure 2:
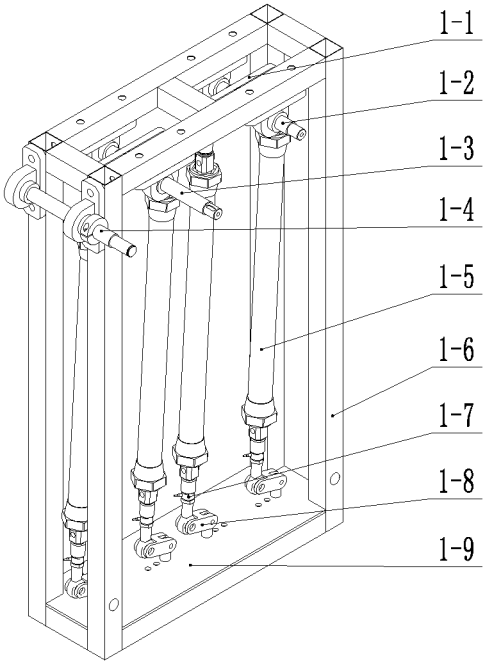
FIG. 2 is a schematic structural diagram of a pneumatic muscle frame of the connecting rod-type lower limb exoskeleton rehabilitation robot according to the embodiment of the present invention.

FIG. 2 is a schematic structural diagram of a pneumatic muscle frame of the connecting rod-type lower limb exoskeleton rehabilitation robot according to the embodiment of the present invention. As shown in FIG. 2, the left and right pneumatic muscle frames are mirror symmetrical, and each includes a thigh rotating shaft 1-2, a calf rotating shaft 1-3, a hip joint shaft 1-4, four pneumatic muscles 1-5 and a support frame 1-6.

As shown in FIG. 2, the support frame 1-6 is integrally formed by welding and is connected to the programmable treadmill 4 by bolts. The thigh rotating shaft 1-2 is fixed on the right side of a top crossbeam of the support frame 1-6 through two shaft blocks, and a pneumatic muscle rotating arm 1-1 is provided in the middle of the thigh rotating shaft 1-2 by the key connection. A pneumatic muscle 1-5 on which a force sensor 1-7 is provided is hinged at each end of the pneumatic muscle rotating arm 1-1, and a joint bearing is provided at each end of the pneumatic muscle 1-5, in which a pneumatic muscle connecting piece 1-8 is hinged to the lower joint bearing. The calf rotating shaft 1-3 is fixed on the left side of the top crossbeam of the support frame 1-6 through two shaft blocks, and its connection with the pneumatic muscles 1-5 is the same as that of the thigh rotating shaft 1-2. The hip joint shaft 1-4 is fixed to the upper left side of the support frame 1-6 through a shaft block. On the pneumatic muscle rotating arms 1-1 and the base plate 1-9, three mounting holes are provided with respect to one pneumatic muscle 1-5 such that the rotating moment arm between the pneumatic muscle 1-5 and the corresponding rotating shaft is adjustable.

Figure 3:
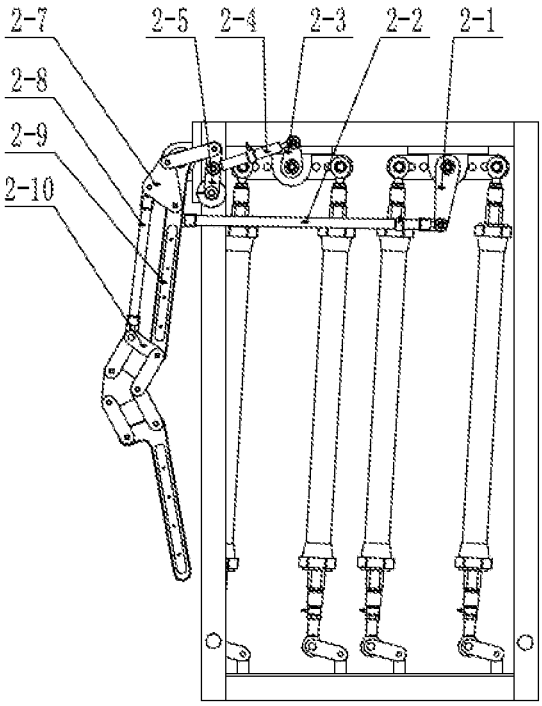
FIG. 3 is a schematic structural diagram of a transmission device of the connecting rod-type lower limb exoskeleton rehabilitation robot according to the embodiment of the present invention.

FIG. 3 is a schematic structural diagram of a transmission device of the connecting rod-type lower limb exoskeleton rehabilitation robot according to the embodiment of the present invention. As shown in FIG. 3, the transmission device 2 includes a thigh transmission mechanism and a calf transmission mechanism. The thigh transmission mechanism is a parallel four-connecting-rod mechanism composed of a thigh rotating arm 2-1, a thigh connecting rod 2-2 and a thigh skeleton 2-9, in which the thigh rotating arm 2-1 is in key connection with the thigh rotating shaft 1-2, a pressure sensor is provided in the middle of the thigh connecting rod 2-2, and an angle sensor 4-3 is provided between the thigh connecting rod 2-2 and the thigh rotating arm 2-1. The calf transmission mechanism consists of two four-connecting-rod mechanisms: a first four-connecting-rod mechanism composed of a first calf rotating arm 2-3, a first calf connecting rod 2-4 and a second calf rotating arm 2-5, and a second four-connecting-rod mechanism composed of the triangular piece 2-7, a knee joint short connecting rod 2-10, a calf long connecting rod 2-8 and a thigh skeleton 2-9. In addition, the first calf rotating arm 2-3 is in key connection with the calf rotating shaft 1-3. An angle sensor 4-3 is provided between the triangular piece 2-7 and the calf long connecting rod 2-8.

Figure 4:
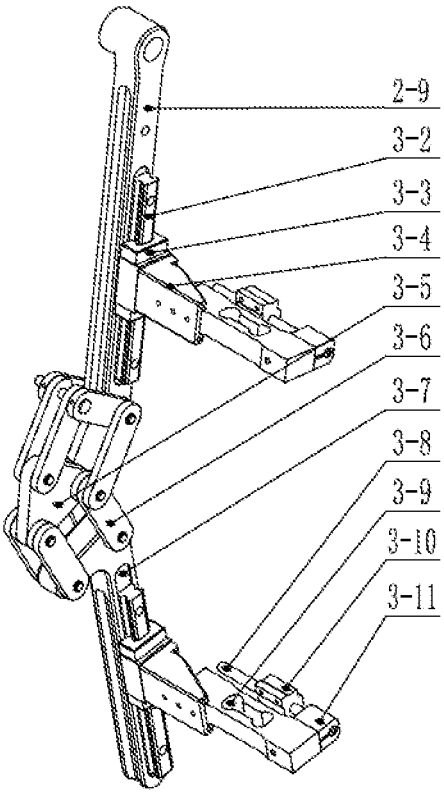
FIG. 4 is a schematic structural diagram of a lower limb exoskeleton of the connecting rod-type lower limb exoskeleton rehabilitation robot according to the embodiment of the present invention.

FIG. 4 is a schematic structural diagram of a lower limb exoskeleton of the connecting rod-type lower limb exoskeleton rehabilitation robot according to the embodiment of the present invention. As shown in FIG. 4, the lower limb exoskeleton includes a thigh portion and a calf portion which have the same structure, and specifically includes a thigh skeleton 2-9, slide rails 3-2, sliding blocks 3-3, sensor fixing bases 3-4, a knee joint triangular piece 3-5, knee joint long connecting rods 3-6, a calf skeleton 3-7, guide pillars 3-8, cantilever beam sensors 3-9, bandage sliding blocks 3-10 and guide pillar fixing bases 3-11.

Further, the thigh skeleton 2-9 is in interference fit with the hip joint shaft 1-4, the slide rail 3-2 is fixed on the thigh skeleton 2-9 through screws, and the sliding block 3-3 can slide up and down. The cantilever beam sensor 3-9 has one side fixed on the sensor fixing base 3-4 through screws and the other side connected to the guide pillar fixing base 3-11, and the bandage sliding block 3-10 can slide left and right on the guide pillar 3-8. The knee joint is composed of two parallel four-connecting-rod mechanisms, and the knee joint triangular piece 3-5 is between the two parallel four-connecting-rod mechanisms.

Figure 5:
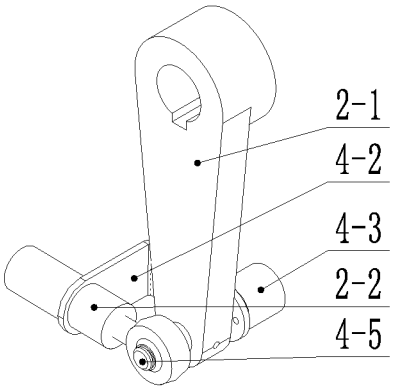
FIG. 5 is a schematic diagram showing an installation method of an angle sensor of the connecting rod-type lower limb exoskeleton rehabilitation robot according to the embodiment of the present invention.

FIG. 5 is a schematic diagram showing the installation method of an angle sensor of the connecting rod-type lower limb exoskeleton rehabilitation robot according to the embodiment of the present invention. As shown in FIG. 5, the angle sensor 4-3 is mounted in the following manner: a small hole is formed at the right end of a pin shaft 4-5 and is in clearance fit with the rotating shaft of the angle sensor 4-3, and the angle sensor 4-3 is fixedly connected to the pin shaft 4-5 by screws; a housing of the angle sensor 4-3 is connected to a sensor bracket 4-2 by screws, and the other end of the sensor bracket 4-2 is connected to the thigh connecting rod 2-2; and the pin shaft 4-5 is in interference fit with the thigh rotating arm 2-1, and they are fixed together by set screws.

In this embodiment, the programmable treadmill 4 is a low-speed treadmill whose speed is changeable by programming.

During work, the left and right exoskeletons are respectively fixed to the lower limbs of the wearer through the thigh and calf bandages, thereby completing the wear of the exoskeletons. In starting up for preparation, eight pneumatic muscles are inflated such that the pneumatic muscle connecting pieces are tightened. The intention of the wearer is determined based on the data measured by the sensors, and then a pair of pneumatic muscles corresponding to each rotating shaft is controlled by the controller to be respectively inflated and deflated such that the corresponding rotating shaft is driven to rotate. The rotation of the rotating shaft is transmitted to the hip joint and the knee joint through the transmission system so as to drive the hip joint and the knee joint to rotate, thereby completing the action of walking rehabilitation.

While particular embodiments of the present invention have been shown and described, it will be obvious to those skilled in the art that changes and modifications may be made without departing from the spirit and scope of the present invention.

The present invention is claimed by:

1. A connecting rod-type lower limb exoskeleton rehabilitation robot, comprising a treadmill, two pneumatic muscle frames, two transmission devices and two lower limb exoskeletons, wherein the two pneumatic muscle frames are respectively provided on two sides of the treadmill and each include a thigh rotating shaft, a calf rotating shaft, a hip joint shaft, pneumatic muscles, and a support frame; wherein in each of the two pneumatic muscles frames: the support frame is connected to the treadmill by bolts, the thigh rotating shaft is fixed on one side of a top crossbeam of the support frame through two shaft blocks, the calf rotating shaft is fixed on the other side of the top crossbeam of the support frame through two shaft blocks, the thigh rotating shaft and the calf rotating shaft are each provided with a pneumatic muscle rotating arm, having a respective one of the pneumatic muscles hinged at each end of the pneumatic muscle rotating arm, and the hip joint shaft is fixed to an outer side of the support frame by a shaft block;

the two transmission devices each include a thigh transmission mechanism and a calf transmission mechanism; wherein in each of the two transmission devices: the thigh transmission mechanism is a parallel four-connecting-rod mechanism composed of a thigh rotating arm, a thigh connecting rod and a thigh skeleton, the calf transmission mechanism includes a first four-connecting-rod mechanism and a second four-connecting-rod mechanism, the first four-connecting-rod mechanism comprising a first calf rotating arm, a first calf connecting rod and a second calf rotating arm, the second four-connecting-rod mechanism comprising a triangular piece, a calf long connecting rod, a knee joint short connecting rod and the thigh skeleton;

the two lower limb exoskeletons each includes a thigh portion, a knee joint, and a calf portion for fixing a wearer's thigh and calf portions, the two lower limb exoskeletons are respectively connected to a respective one of the two pneumatic muscle frames through a respective one of the two transmission devices wherein in each connected one of the two lower limb exoskeletons, the respective one of the two pneumatic muscle frames, and the respective one of the two transmission devices: the pneumatic muscles are configured to be inflated and deflated to drive the thigh rotating shaft and the calf rotating shaft to rotate according to the wearer's movement intention and then to drive the hip joint shaft and the knee joint to rotate, thereby achieving the action of walking rehabilitation.

2. The connecting rod-type lower limb exoskeleton rehabilitation robot of claim 1, wherein in one of the connected one of the two lower limb exoskeletons, the respective one of the two pneumatic muscle frames, and the respective one of the two transmission devices:

the thigh portion and the calf portion have the same structure, and include the thigh skeleton, slide rails, sliding blocks, sensor fixing bases and a calf skeleton, the calf skeleton having the same structure as the thigh skeleton, in which the thigh skeleton is in interference fit with the hip joint shaft, the slide rails are respectively fixed on the thigh skeleton and the calf skeleton by screws, and in each of the thigh portion and the calf portion: a respective one of the sliding blocks is arranged on a surface of a respective one of the slide rails and passes through a respective one of the sensor fixing bases so as to drive the respective one of the sensor fixing bases to slide on the respective one of the slide rails.

3. The connecting rod-type lower limb exoskeleton rehabilitation robot of claim 2, wherein in one of the two lower limb exoskeletons:

a cantilever beam sensor is connected to one of the sensor fixing bases by screws, a guide pillar fixing base is provided at an end of the cantilever beam sensor, the guide pillar fixing base has a through hole for receiving a guide pillar, the guide pillar is cylindrical, and a bandage sliding block is sleeved and slidable on the guide pillar.

4. The connecting rod-type lower limb exoskeleton rehabilitation robot of claim 1, wherein one of the two lower limb exoskeletons:

the knee joint includes two parallel four-connecting-rod mechanisms, each comprising a plurality of knee joint long connecting rods, a knee joint triangular piece is provided between the two parallel four-connecting-rod mechanisms of the knee joint, and the knee joint triangular piece is connected to the thigh skeleton and a calf skeleton of the calf portion through one of the two parallel four-connecting-rod mechanisms of the knee joint.

5. The connecting rod-type lower limb exoskeleton rehabilitation robot of claim 1, wherein in one of the two transmission devices, an angle sensor is respectively provided between the triangular piece and the calf long connecting rod and between the thigh connecting rod and the thigh rotating arm.

6. The connecting rod-type lower limb exoskeleton rehabilitation robot of claim 5, wherein in the one of the two transmission devices: a housing of the angle sensor is connected to a sensor bracket by screws, the sensor bracket being used for connecting with the thigh connecting rod, the thigh skeleton or the triangular piece, and a rotating shaft of the angle sensor is connected to the thigh rotating arm, the calf long connecting rod or the second calf connecting rod by a pin shaft.

7. The connecting rod-type lower limb exoskeleton rehabilitation robot of claim 1, wherein on one of the pneumatic muscle rotating arms and a base plate of the support frame, three mounting holes are provided with respect to one of the pneumatic muscles such that the rotating moment arm between the one of the pneumatic muscles and the corresponding rotating shaft is adjustable.

8. The connecting rod-type lower limb exoskeleton rehabilitation robot of claim 1, wherein a force sensor is mounted on one of the pneumatic muscles to measure the force of the pneumatic muscle, a joint bearing is provided at each of an upper end and at a lower end of the one of the pneumatic muscles, and a pneumatic muscle connecting piece is hinged to the joint bearing at the lower end of the one of the pneumatic muscles.

9. The connecting rod-type lower limb exoskeleton rehabilitation robot of claim 1, wherein in one of the connected one of the two lower limb exoskeletons, the respective one of the two pneumatic muscle frames, and the respective one of the two transmission devices: the thigh rotating shaft is in key connection with the pneumatic muscle rotating arms and the thigh rotating arm, respectively.

10. The connecting rod-type lower limb exoskeleton rehabilitation robot of claim 1, wherein the number of the pneumatic muscles in each pneumatic muscle frame is four.

* * * * *